United States Patent [19]

Belokin

[11] Patent Number: 4,569,462

[45] Date of Patent: Feb. 11, 1986

[54] DISPENSING CONTAINER FOR POWDERY, GRANULAR AND PELLET-LIKE MATERIALS

[75] Inventor: Martin P. Belokin, Denton, Tex.

[73] Assignee: Martin Paul, Inc., Denton, Tex.

[21] Appl. No.: 648,521

[22] Filed: Sep. 10, 1984

[51] Int. Cl.[4] ..... B67D 3/00

[52] U.S. Cl. ..... 222/180; 222/480; 222/561; 206/818; 229/17 SC; 248/206.5

[58] Field of Search ..... 248/206.5, 311.3; 211/DIG. 1; 220/354; 206/818; 229/17 SC; 222/142.3, 179.5, 173, 180, 196, 196.1–196.2, 544, 559, 561, 478, 480, 565

[56] References Cited

U.S. PATENT DOCUMENTS

| | | | |
|---|---|---|---|
| 1,754,482 | 4/1930 | Nicholls | 222/561 X |
| 2,878,971 | 3/1959 | Malachick | 222/480 X |
| 2,964,812 | 12/1960 | Cook | 248/206.5 X |
| 3,154,225 | 10/1964 | Wadlinger et al. | 222/565 X |
| 4,094,456 | 6/1978 | Roccaforte | 229/17 SC |

FOREIGN PATENT DOCUMENTS

| | | | |
|---|---|---|---|
| 2295889 | 7/1976 | France | 222/480 |
| 414509 | 8/1934 | United Kingdom | 229/17 SC |
| 969015 | 9/1964 | United Kingdom | 222/480 |

*Primary Examiner*—Joseph J. Rolla
*Assistant Examiner*—Michael S. Huppert
*Attorney, Agent, or Firm*—James E. Nilles

[57] ABSTRACT

A container for powdery, granular and pellet-like materials comprises a receptacle with an open front, a cover which overlies that open front, and a retaining member that overlies the cover and holds it in place. For slidable securement to the receptacle, the retaining member has rearwardly projecting channel portions along its opposite side edges, defining laterally inwardly opening grooves that receive laterally outwardly projecting flanges on the receptacle side walls, at their front edges. The retaining member is made of an elastomeric plastic impregnated with magnetized material and has a flat front face for magnetic adherence to an upright wall of a refrigerator or range. A hole in the retaining member registers with an aperture in the cover to provide a dispensing outlet that is normally open but is sealed by magnetic attachment to a supporting surface.

4 Claims, 8 Drawing Figures

DISPENSING CONTAINER FOR POWDERY, GRANULAR AND PELLET-LIKE MATERIALS

FIELD OF THE INVENTION

This invention relates to small containers for storing powdery, granular and pellet-like materials and from which such materials can be dispensed in small quantities, and the invention relates more particularly to a container for vitamin tablets, salt, spices, condiments and the like which is readily detachably securable to an upright metal wall such as that of a refrigerator or a kitchen range, to be out of the way but instantly available, and which has a normally open dispensing outlet that is automatically closed by its securement to such a wall.

BACKGROUND OF THE INVENTION

Small containers for spices, granular and powdered condiments, vitamin tablets and similar materials have conventionally been provided with a top closure that must be opened before the contents of the container can be dispensed. Although the opening of such a container takes but an instant, it must either be performed with the use of two hands or with a very deft manipulation of the fingers of one hand. When not in use, such a container must be stored on a shelf, counter top or other horizontal surface, often among other generally similar containers which together create a cluttered appearance and intrude upon working space.

Salt and pepper shakers usually have dispensing holes in their tops, and in the interests of convenience they are not provided with caps or closures. When not in use they must be stored with their apertured surfaces uppermost, and, again, they are designed to rest on a horizontal surface. Most salt and pepper shakers are easily knocked over when they rest on a horizontal surface, and the annoying spillage of salt or pepper that results from inadvertently striking such a container is a common experience.

The inconveniences occasioned by the conventional arrangement of containers for granular, powdery and pellet-like materials are of course relatively minor, and because there has been no obvious solution to them, they have come to be accepted as inevitable. These inconveniences are nevertheless frequently encountered, so that their elimination is worthy of attention.

SUMMARY OF THE INVENTION

The general object of the present invention is to provide an attractive and inexpensive container for granular, powdery and pellet-like materials which does not have the disadvantages and deficiencies set forth above.

More specifically it is an object of this invention to provide a container for materials of the class just described that is magnetically attachable for storage to an upright metal wall of a refrigerator or kitchen range to be conveniently available close to where it is usually needed, and having a dispensing outlet that is normally open but is securely sealed by magnetic securement of the container to such a wall.

It is also a specific object of this invention to provide a dispensing container of the above described character that can be stored without occupying space on a horizontal surface, can be instantly removed from and returned to its storage position with the utmost facility and convenience, and can be relied upon to resist spillage of its contents when it is stored, not-withstanding that it has a normally open dispensing outlet.

A further specific object of this invention is to provide a dispensing container which achieves the above stated objects and which, in addition, is easily filled and is easily adaptable for dispensing either of two different materials, such as salt or pepper, large vitamin pills or small ones, and powdery or granular spices.

It is also a specific object of this invention to provide a convenient and attractive container which achieves the objectives set forth above but which is nevertheless inexpensive, comprising only three simple parts, two of which can be molded of plastic and the third of which can be formed as an extrusion.

These and other objects which will appear as the description proceeds are achieved in the container of this invention, which is adapted for storing and dispensing powdery, granular and pellet-like materials, comprising a box-like receptacle which is open at a front thereof and which has a rear wall, a pair of side walls that have vertically elongated lengthwise parallel front edges, and top and bottom walls that have front edges near a plane that contains the front edges of both of the side walls. The container of this invention is characterized by a laterally outwardly projecting flange on each of said side walls adjacent to the front edge thereof and extending along at least a substantial portion of that front edge. For closing the open front of the receptable there is a removable cover having opposite front and rear surfaces and top, bottom and side edges and which further has marginal portions of its rear surface arranged to closely overlie the front edges of the top, bottom and side walls all along the length of each. The cover further has boss means adjacent to said marginal portions and projecting rearwardly beyond them for engaging inner surface portions of the top, bottom and side walls to confine the cover against edgewise sliding relative to the receptacle, and has an aperture near its top edge through which material can issue from the receptacle. The cover is normally confined against forward displacement off of the receptacle by a retaining member having a substantially flat front surface, a rear surface for closely overlying the front surface of the cover, and a rearwardly projecting elongated channel portion extending along each of a pair of opposite side edges of the retaining member, each said channel portion defining an elongated groove which opens laterally towards the other channel portion and wherein one of said flanges is receivable, said channel portions being cooperable with said flanges to slidably connect the retaining member to the receptable in closely overlying relation to the cover. The retaining member is impregnated with magnetized material to be magnetically securable to an upright supporting surface with its said front surface flatwise engaging the supporting surface. On the top of the receptacle, adjacent to its open front, it has protuberance means defining a downwardly facing abutment against which an upper edge portion of the retaining member is engageable to prevent the receptacle and the cover from sliding downward relative to the retaining member past a position in which a hole through the retaining member is in register with the aperture in the cover.

Preferably the front edges of the top, bottom and side walls of the receptacle are coplanar and its flanges have front surfaces which are coplanar with those front edges. There is an upwardly projecting flange on the top wall of the receptacle, extending along its front edge and having opposite end portions which project laterally beyond the flanges on the side walls to comprise the protuberance means.

With the top, bottom and side walls of the receptacle coplanar with one another and with the front surfaces of the flanges, the marginal portions of the rear surface of the cover are disposed in a common plane, the cover has a width equal to the distance between the remote edges of said flanges on the side walls of the cover to overlie those flanges as well as said front edges, and the boss means on the cover comprises a shallow rearwardly projecting boss, the edges of which engage inner surfaces of the top, bottom and side walls all along the front edge of each and adjacent thereto.

Preferably the cover has a second aperture, spaced from its bottom edge by substantially the same distance that the first mentioned aperture is spaced from its top edge, so that a selected one of those two apertures can register with the hole in the retaining member while the other is covered by the retaining member.

BRIEF DESCRIPTION OF THE DRAWINGS

In the accompanying drawings, which depict what are now regarded as preferred embodiments of the invention.

DETAILED DESCRIPTION OF PREFERRED EMBODIMENT OF THE INVENTION

Figure 1:
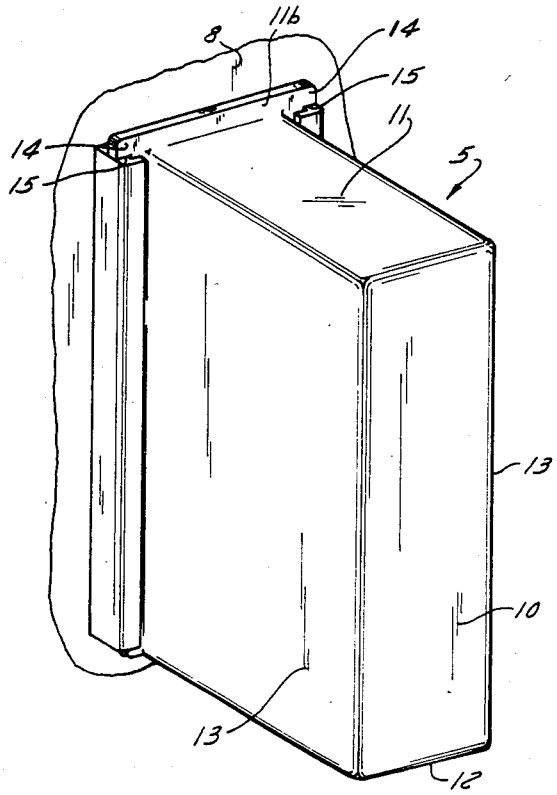
FIG. 1 is a perspective view of the container.
Figure 3:
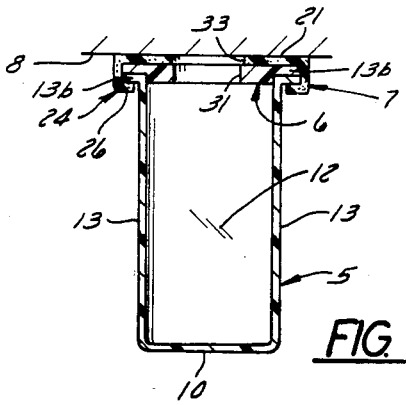
FIG. 3 is a view of the container in horizontal section, taken on the plane of its outlet.

A container of this invention comprises three parts, namely a receptacle 5 that is open at its front, a cover 6 that normally closes the open front of the receptacle, and a retaining member 7 that holds the cover in place and provides for readily detachably mounting the receptable on an upright magnetically permeable support such as a refrigerator side wall or door.

The receptacle 5 can be readily molded in one piece, preferably of a transparent plastic. It has a rectangular vertically elongated rear wall 10, top and bottom walls 11 and 12, respectively, and upright side walls 13, all of which are flat and meet at substantially right-angle corners. At the open front of the container the front edges of its respective top, bottom and side walls 11, 12, 13 are coplanar.

Along the front edge of each of the side walls 13 there extends a laterally outwardly projecting flange **13*b*. An upwardly projecting flange 11*b* on the top wall 11 extends lengthwise all along its front edge and across and beyond the upper ends of the side flanges 13*b* to have tab-like portions 14 which project sidewardly beyond the side flanges and define downwardly facing abutments 15 for cooperation with the retaining member 7** as explained hereinafter.

The several flanges **11*b* and 13*b* preferably have their front surfaces coplanar with one another and with the front edges of the respective walls 11, 13** from which they project. It will be observed that the receptacle has no laterally inward projections at its open front end, and therefore it can be molded of plastic with the use of a very simple and inexpensive die set.

The cover 6 preferably has a flat front surface 17 and has at its opposite rear side a shallow rectangular boss 18 which projects into the receptacle when the cover is in place on it. The rectangular boss 18 has straight edges that engage the inner surfaces of the respective top, bottom and side walls 11, 12, 13, adjacent to the front edges of those walls and all along those front edges, to confine the cover against edgewise sliding relative to the receptacle. All around the boss 18 the cover has a coplanar marginal rear surface portion 19 that overlies the front edges of the top, bottom and side walls and also overlies the side flanges **13*b* of the receptacle, the width of the cover being equal to the distance between the remote edges of the side flanges 13*b*. It will be apparent that the cover 6 can be molded of plastic with the use of a very simple and inexpensive die set. Nevertheless, the cover, when in place, makes a good seal with the receptacle, owing to its engagement therewith not only along the front edges of its walls 11, 12, 13** but also around the inner surfaces of those walls near their front edges.

The retaining member 7 is rectangular, having a length equal to that of the cover 6 and a width somewhat greater than that of the cover. It has a flat front surface 21 and an opposite flat rear surface 22. Along each of the side edges of the retaining member there extends an integral rearwardly projecting channel portion 24 that is L-shaped in cross section, having a rearwardly projecting leg 25 and a laterally inwardly projecting leg 26 which overlies the rear surface 22 in rearwardly spaced relation to it. Each channel portion thus defines a groove 27 which extends along the full length of the retaining member and which opens laterally towards the opposite channel portion. Each of these grooves 27 has a width to slidably receive one of the side flanges **13*b* on the receptacle and its overlying marginal portion of the cover. Thus, with the cover 6 in place on the receptacle 5, the retaining member can be slid lengthwise upwardly over the cover, in engagement with the side flanges 13*b***, to clampingly flatwise confine the cover in place on the receptacle.

The upward limit of sliding motion of the retaining member 7 relative to the receptacle 5 is defined by the tab-like projections 14 on the top of the receptacle, the lower edges 15 of which serve as abutments that engage the upper ends of the rearwardly projecting legs 25 of the channel portions 24.

It will be seen that the retaining member 7 has a uniform transverse cross-section all along its length and is, moreover, symmetrical to its longitudinal centerline. It can therefore be produced as a simple and inexpensive extrusion cut to length. The retaining member is made of an elastomeric plastic impregnated with magnetic material so that it can magnetically cling to a metal supporting surface 8. Because of its elasticity it can be dimensioned to have a close, rather snug fit on the receptacle and over the cover but nevertheless be easily slidable to and from assembled relationship with them.

Figure 2:
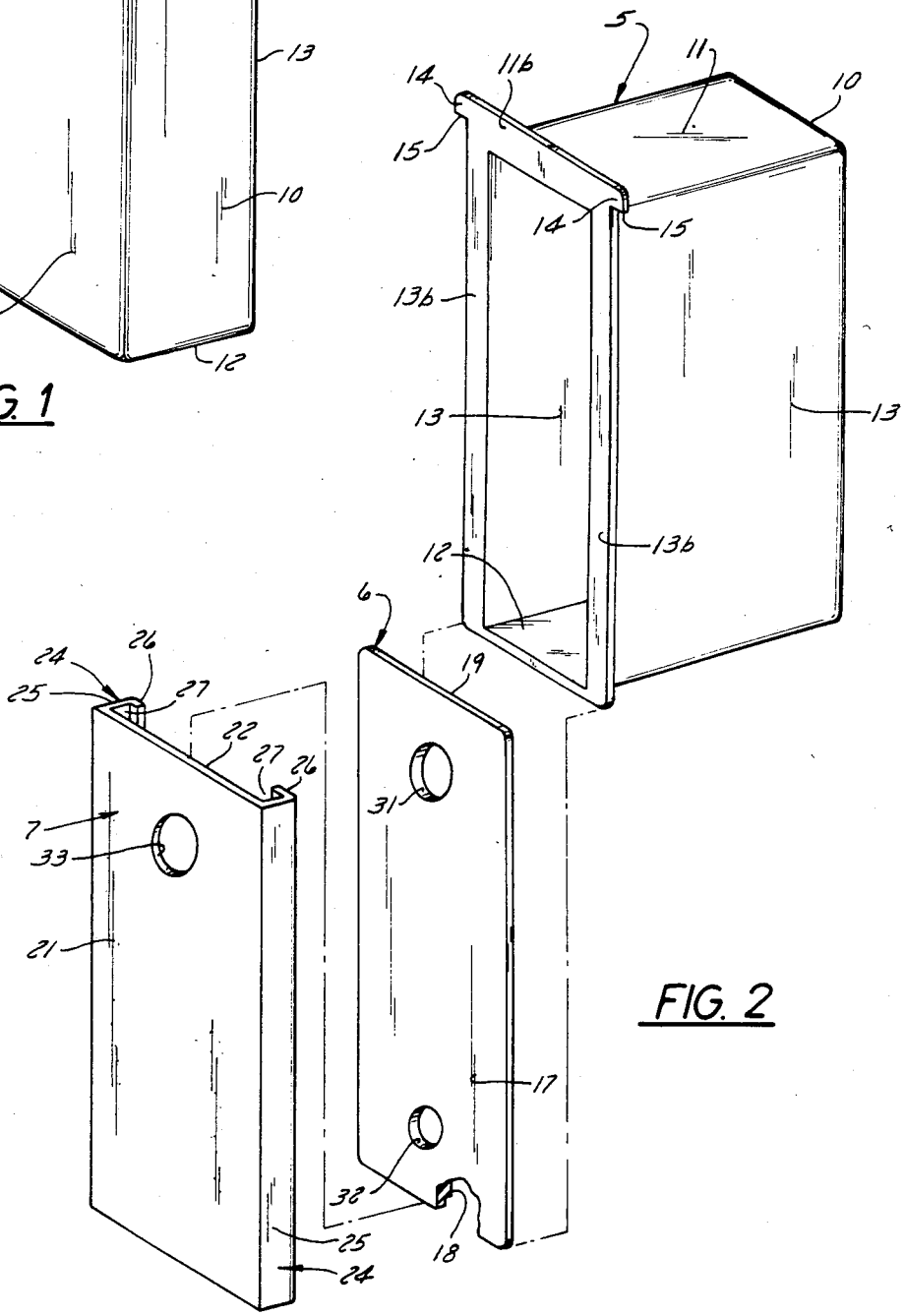
FIG. 2 is a disassembled perspective view of the container.
Figure 4:
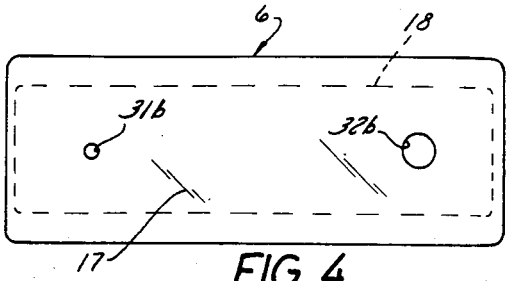
FIGS. 4, 5 and 6 are views of the cover in front, side and top elevation, respectively.
Figure 5:
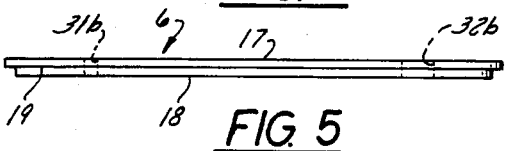
Figure 6:
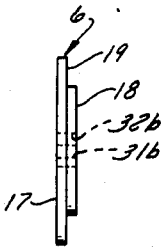
Figure 7:
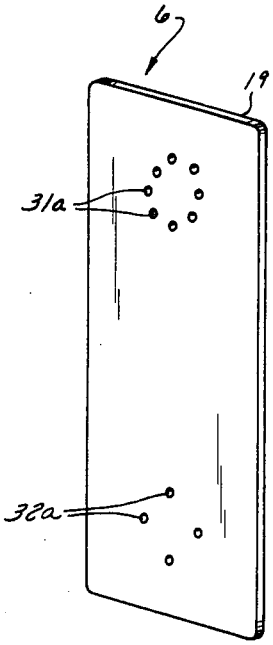
FIG. 7 is a perspective view of a modified form of cover.
Figure 8:
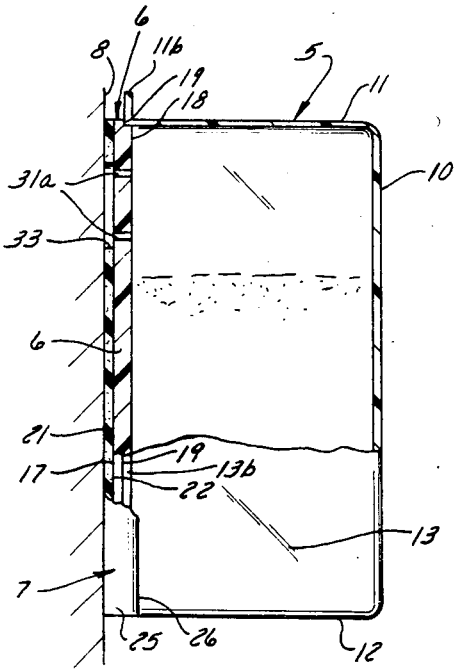
FIG. 8 is a view of the container partly in side elevation and partly in vertical section.

For dispensing the contents of the container the cover has two apertures 31, 32 through it, one near each of its ends, and there is a hole 33 through the retaining member 7 that can register with one of the apertures 31, 32 when the cover and the retaining member are assembled with the receptacle. The two apertures 31, 32 in the cover, which are spaced like distances from the respective end edges of the cover, are of different sizes, so that in cooperation with the retaining member hole 33 they can adapt the container for dispensing either one of two somewhat different materials. Thus in the cover shown in FIG. 7, the aperture 31*a* comprises a small number of small holes to comprise a pepper shaker outlet, while the aperture 32*a* consists of more numerous and slightly larger holes to comprise a salt shaker outlet; in the cover shown in FIG. 4, the aperture 31*b*. is a single relatively small hole for dispensing powdered spices and the like while the aperture 32*b* is a larger single hole through which peppercorns or the like can pass; and the cover shown in FIG. 2, has still larger holes 31 and 32 that are of two different sizes, the smaller one 32 being suitable for small vitamin pills or the like and the larger one 31 being suitable for larger pills or tablets, or for small parts such as nuts, bolts and washers.

In assembling the container after it has been filled, the cover is installed with the appropriate aperture uppermost, that is, nearer the flange 11*b*, which identifies the top of the container. When the retaining member is installed, its hole 33 registers with the upper aperture 31 or 32 in the cover and it closes and seals the other aperture 32 or 31. Thus the aperture 31 or 32 that is uppermost will be fully open when the container is disengaged from a supporting surface 8, and therefore the container should be filled less than full, so that its contents will be below the level of the hole in the retaining member. Of course when the container is magnetically adhered to a metal supporting surface 8, that surface will seal the container.

From the foregoing description taken with the accompanying drawings it will be apparent that this invention provides a very convenient and attractive container for powdery, granular and pellet-like materials, capable of magnetic adherence to a metal supporting surface such as a wall of a refrigerator cabinet or kitchen range, to be out of the way but nevertheless readily available when stored. The container of this invention also features an outlet which is normally open but which is automatically sealed when the container is stored, and because of its magnetic adherence to a supporting surface it resists upset and spillage notwithstanding that normally open outlet.

What is claimed as the invention is:

1. A container for storage of powdery, granular and pellet-like materials and from which such materials can be dispensed, said container comprising a box-like receptacle which is open at a front thereof and which has a rear wall, a pair of opposite side walls that have vertically elongated lengthwise parallel front edges, and top and bottom walls that have front edges near a plane that contains the front edges of both of the side walls, said container being characterized by:

A. a laterally outwardly projecting flange on each of said side walls, adjacent to the front edge thereof and extending along at least a substantial portion of the length of that front edge;

B. a removable cover for closing the open front of said receptacle, having opposite front and rear surfaces and top, bottom and side edges, said cover further having (1) marginal portions of its rear surface arranged to closely overlie the front edges of said top, bottom and side walls all along the length of each, (2) boss means adjacent to said marginal portions and projecting rearwardly beyond them for engaging inner surface portions of said top, bottom and side walls to confine the cover against edgewise sliding relative to the receptacle, and (3) an aperture near said top edge through which material can issue from the receptacle;

C. a retaining member for confining the cover against forward displacement off of the receptacle, said retaining member having (1) a substantially flat front surface, (2) an opposite rear surface for closely overlying the front surface of said cover, and (3) a rearwardly projecting elongated channel portion extending along each of a pair of opposite side edges thereof, each said channel portion defining an elongated groove which opens laterally towards the other channel portion and wherein one of said flanges is receivable, said channel portions being cooperable with said flanges to slideably connect the retaining member to the receptacle in closely overlying relation to the cover, said retaining member being impregnated with magnetized material to be magnetically securable to an upright supporting surface with its said front surface flatwise engaging the same; and D. protuberance means on the top of said receptacle, adjacent to its open front, defining a downwardly facing abutment against which an upper edge portion of the retaining member is engageable to prevent the receptacle and the cover from sliding downward relative to the retaining member past a position in which a hole through the retaining member is in register with said aperture in the cover.

2. The container of claim 1 wherein the front edges of said top, bottom and side walls of the receptacle are coplanar and wherein said flanges have front surfaces that are coplanar with said edges, further characterized by:

an upwardly projecting flange on said top wall of the receptacle, extending along the front edge thereof and having opposite end portions which project laterally beyond said flanges on the side walls to comprise said protuberance means.

3. The container of claim 1 wherein the front edges of the top, bottom and side walls of the receptacle are coplanar and wherein said flanges have front surfaces that are coplanar with said edges, further characterized by:

(1) said marginal portions of the rear surface of the cover being disposed in a common plane, (2) said cover having a width equal to the distance between the remote edges of said flanges, to overlie the flanges as well as said front edges, and (3) said boss means on the cover comprising a shallow, rearwardly projecting boss thereon, the edges of which engage inner surfaces of the top, bottom and side walls all along the front edge of each and adjacent thereto.

4. The container of claim 1 wherein said aperture in the cover is spaced a distance from the top edge thereof, further characterized by:

the cover having a second aperture therein, spaced a substantially equal distance from its bottom edge so that a selected one of said apertures can register with said hole in the retaining member while the other is covered by the remaining member.

* * * * *